United States Patent [19]

Hudson

[11] Patent Number: 4,897,022

[45] Date of Patent: Jan. 30, 1990

[54] MULTI-TANK/MULTI-PUMP WATER PRESSURE BOOSTER SYSTEM

[76] Inventor: Carl E. Hudson, P.O. Box 506, Oroville, Calif. 95965-0506

[21] Appl. No.: 223,955

[22] Filed: Jul. 25, 1988

[51] Int. Cl.[4] ..... F04B 23/02

[52] U.S. Cl. ..... 417/7; 417/540

[58] Field of Search ..... 417/7, 5, 4, 3, 2, 540; 60/416, 418

[56] References Cited

U.S. PATENT DOCUMENTS

| | | | |
|---|---|---|---|
| 3,572,381 | 3/1971 | Nash | 137/568 |
| 3,639,081 | 2/1972 | Gray et al. | 417/7 |
| 3,744,932 | 7/1973 | Prevett | 417/8 |
| 3,746,471 | 7/1973 | Gray et al. | 417/7 |
| 3,775,025 | 11/1973 | Maher et al. | 417/7 |
| 4,290,735 | 9/1981 | Sulko | 417/2 |
| 4,344,741 | 8/1982 | Taki | 417/28 |
| 4,799,864 | 1/1989 | Hockley | 417/7 |

FOREIGN PATENT DOCUMENTS

| | | | |
|---|---|---|---|
| 2112922 | 10/1972 | Fed. Rep. of Germany | 417/4 |

*Primary Examiner*—Leonard E. Smith

[57] ABSTRACT

A multiple pump supply system having multiple pumps placed in parallel and having a plurality of reservoirs connected to acommon discharge line. The pumps are operated sequentially on demand sensed by a pressure sensor located at the mouth of the first reservoir and controlling a first pump. Multiple sensors located at the mouth of a second reservoir control the subsequent pumps sequentially.

1 Claim, 4 Drawing Sheets

MULTI-TANK/MULTI-PUMP WATER PRESSURE BOOSTER SYSTEM

TECHNICAL FIELD

This invention relates to a multi-tank/multi-pump water pressure system, particulary the application of the pump control mechanism.

BACKGROUND ART

The prior art researched has clearly shown a number of techniques used to provide water through various booster systems. These techniques offer a number of options with various levels of success, in providing controlled water booster systems.

U.S. Pat. No. 4,344,741 (TOMOHIKO TAKI) shows an automatic supply system with a single tank having a controlled air charge, preventing the release of water from the pneumatic tank from a single pump supply to maintain a constant source of water.

U.S. Pat. No. 4,290,735 (SULKO) shows a plurality of pumps each being of a capacity to provide high head and volume disposed into a common manifold to provide pressure boosted water in a highrise building using a pressurestatic switch as means of control consisting of various control switches and relays, with an auxiliary pump having an accumulator tank.

U.S. Pat. No. 3,775,025 (MAHER & MAHER) shows a constant pressure pumping system unit consisting of two pumps, one being of variable speed providing a constant pressure, whereas the second pump provides constant speed with control switches providing the perimeters of the system.

U.S. Pat. No. 3,746,471 (GRAY & ANDERSON) shows a water pressure booster system using auxiliary pump to super charge pressurized reservoir, with a plurality of pumps controlled by various relays and sensing switches.

U.S. Pat. No. 3,744,932 (PREVETT) shows an automatic sequence control system for pump motors. This system provides automatic controlling of a plurality of pumps using various control switches, flow meters, relays along with logic gates thus providing a complex control system.

U.S. Pat. No. 3,639,081 (GRAY & ANDERSON) shows a liquid pressure booster system with cutoff for minimum flow levels consisting of a plurality of constant speed pumps and pressure-regulating valves along with time delay relays and a single pressurized tank with various other complex electrical controls.

To the contrary, none of the references show a "MULTI-TANK/MULTI-PUMP WATER PRESSURE BOOSTER SYSTEM" presented by the inventor.

BACKGROUND AND SUMMARY

The present invention relates to tank type water pressure booster systems employing constant speed pumps, and more specifically it relates to water pressure booster systems employing hydropneumatic bladder or diaphragm type tanks and constant speed electrically driven pumps automatically sequenced to operate to satisfy water system flow demand requirements throughout the full system multi-pump capacity without the utilization of control or timing relays or solid state electrical/electronic timing/controlling devices or flow actuated devices to provide water throughout the full system design range at a specified increase of pressure and maintained within acceptable tolerances of a specified design pressure to suit domestic water system service requirements. The term constant pressure is purposely avoided as it is in reality a misnomer in the pumping industry and is both highly impractical and virtually unobtainable in economical domestic water pressure booster systems. Actual system pressure variation of plus five percent, minus ten percent in low pressure (up to 150 PSI design pressure) booster applications is not only acceptable, but quite common and frequently utilized in establishing design parameters of control. In high pressure applications a lesser percentage of pressure variation usually will be found, although a pressure variation of plus 10 PSI, minus 20 PSI on a 250 PSI system is not uncommon. Multipump water booster systems of both tank and tankless types are supplied with inlet pressure either from a conduit or reservoir source of supply at a pressure that is usually lower than is required to meet the domestic water service requirements of the facility being supplied. The pumps are parallel connected and fitted with appropriate isolation and discharge check valves to permit individual operation or simultaneous operation while pumping from a common source into a common conduit, and providing a specified increase in pressure. When required or desired, these pumping systems may be furnished with pressure reducing valves connected either one on the discharge of each pump before entering the common high pressure conduit, or in any desired arrangement of parallel connected pressure reducing valves installed between the common high pressure conduit and the service to the facility. The systems are designed to sequence the pumps as required to satisfy the flow demand of the facility being supplied; automatically selecting the pump or any combination of pumps best suited to satisfy system flow demand at any given time, and (when furnished with auto shut off feature) to turn all pumps off under conditions of no demand. When a system is designed having two or more equally sized pumps, a means of automatic or manual alternation or sequencing selection is usually provided in order to equalize wear and operating time.

Systems furnished with the design features as described above have been found to be highly energy efficient and economical of operation since they have the ability to select the smallest energy consuming combination of pumps required to be in operation to suit the system demand at any given time and (when so equipped) to shut off with zero demand. The application of a hydropneumatic tank (usually an optional item) to such systems further enhances the energy conservation aspect of these systems, since it enables the reservoir capacity of the tank to supply low volume usage to the facility while allowing the system pressure to be reduced from the maximum high value when the pump shuts off at zero demand (+≡to + PSI) to an acceptable low value for system operation (generally −10 to −°PSI). Thus a volume of water can be furnished to the facility without starting a pump. The disadvantages found in most of the above described systems are that the tank and zero or low demand shut off feature is provided only as extra cost options, there are some systems lacking in the ability of the controls to perform a claimed function, and in virtually all systems the method to attain the functions is by means of costly control and timing relay circuitry or solid state electronic control devices coupled with also costly flow sensing devices. Flow and current sensing devices are the most commonly used items for sequencing control of present day state of the art multi-pump automated pump control systems. Both have the common disadvantage of working in combination with timing relays which function to start the next pump of the system instantaneously when the signal from the flow or current sensing device is received, and to maintain the pump in operation for a predetermined period of time. During this transition, the prior operating pump is usually sequenced off.

Brief surge demands are extremely common in many types of buildings, such as hotels, schools, office buildings, apartments, hospitals, entertainment centers, etc. With each occurence, a larger pump may be sequenced on for the predetermined time setting of the timing device while a smaller pump is sequenced off. In extreme cases continuous back and forth cycling between a small pump and a larger pump in a system may continue without cessation throughout the greater part of a day. This is not only hard on the equipment but also wasteful of energy. It is not uncommon to employ time clock control to prevent such cycling from occuring.

Most equipment users desire and specify a type of pump failure feature that will provide an alarm indication and start an alternate pump in the event of failure to a pump while in the operational sequence. This feature is a standard extra cost option for failure of the lead (number one) pump in most designed pumping systems, however most manufacturers do not offer a feature to protect from failure to a main pump except on a custom engineered basis. Another occasionally requested feature by system users is the high suction pressure shut off. With this feature, the pumps are programmed to shut off and remain off if the inlet pressure to the system reaches a predetermined high level sufficient to supply the facility without the boost in pressure provided by the pumps. This too is usually offered as an extra cost option, it is highly desireable for installations wherein the input pressure has wide variation since it automatically prevents the pumps from running unnecessarily.

DESCRIPTION OF THE PREFERRED EMBODIMENTS

Figure 1:
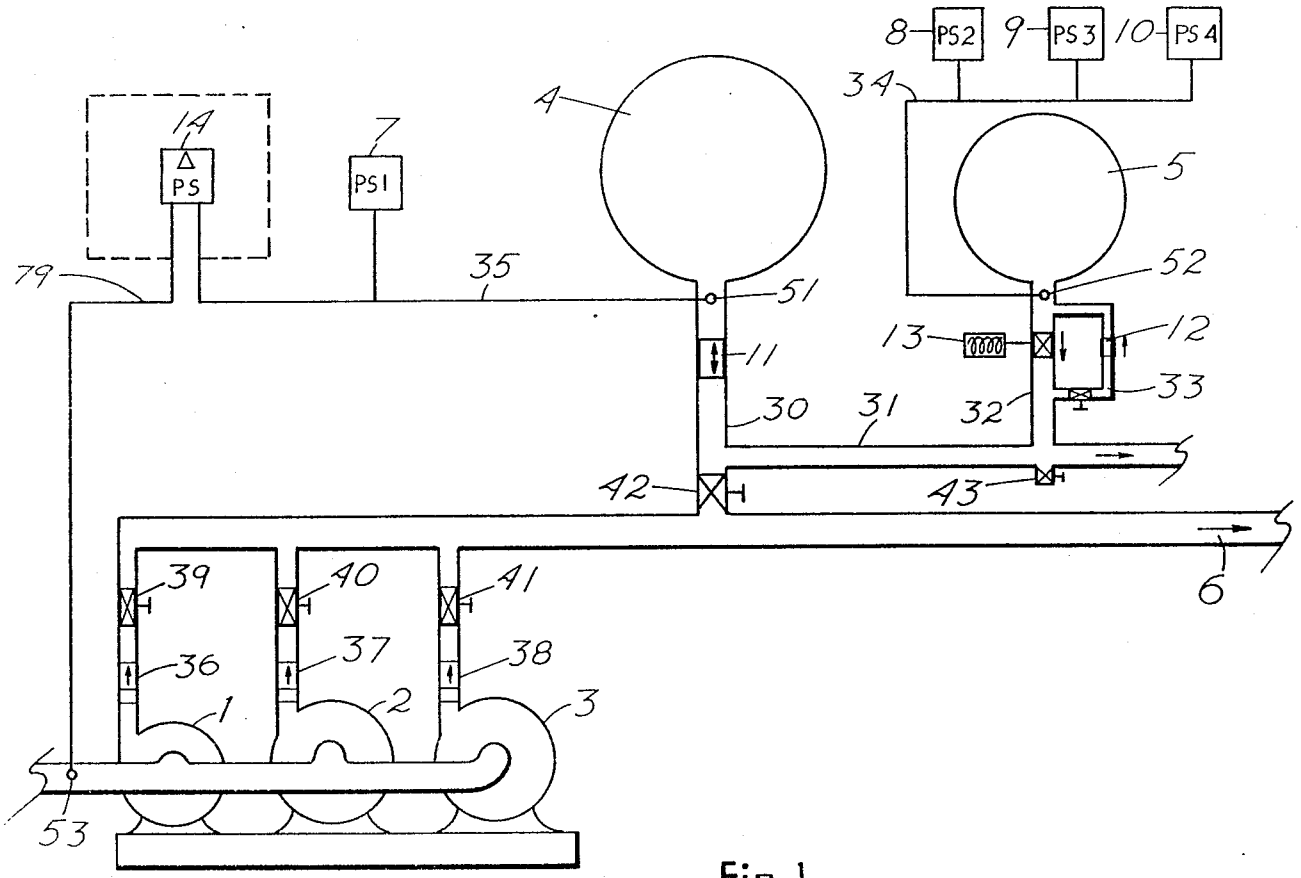
FIG. 1 shows the basic piping arrangement of the water booster system constructed in accordance with an embodiment of the inventor.

FIG. 1 is a diagramatic form of the present invention. Inlet source 15 provides water to suction manifold connected to pumps indicated respectively as 1, 2, 3, which are connected for parallel operation when energized. The output of pump number 1 flows through check valve 36 and through gate valve 39, into service line 6; pump 2 flows through check valve 37 and through gate valve 40 into line 6; pump 3 flows through check valve number 38 and through gate valve 41 into line 6. Primary tank 4 is connected to line 6 by line 30 with a service valve 42 adjacent to line 6 and an orifice check valve 11 between tank 4 and service valve 42 with sensing point 51 directly adjacent to discharge of primary tank 4. Secondary tank 5 is connected to line 6 by line 32 which flows through solenoid valve 13 and intersects line 31 and flows into line 30 between orifice check valve 11 and servicing valve 42, and into line 6. Line number 32 has a sensing point 52 adjacent to secondary tank 5 and a bypass line 33 with check valve 12 around solenoid valve 13 returning into line 32. Pressure sensing switch two 8, pressure sensing switch three 9 and pressure sensing switch four 10 are all connected to sensing point 52 by line 34. Pressure switch one and the high pressure side of pressure differential switch 14 are connected to the sensing point 51 by line 35. The low pressure side of pressure differential switch 14 is connected to sensing point 53 by line 79.

Figure 2:
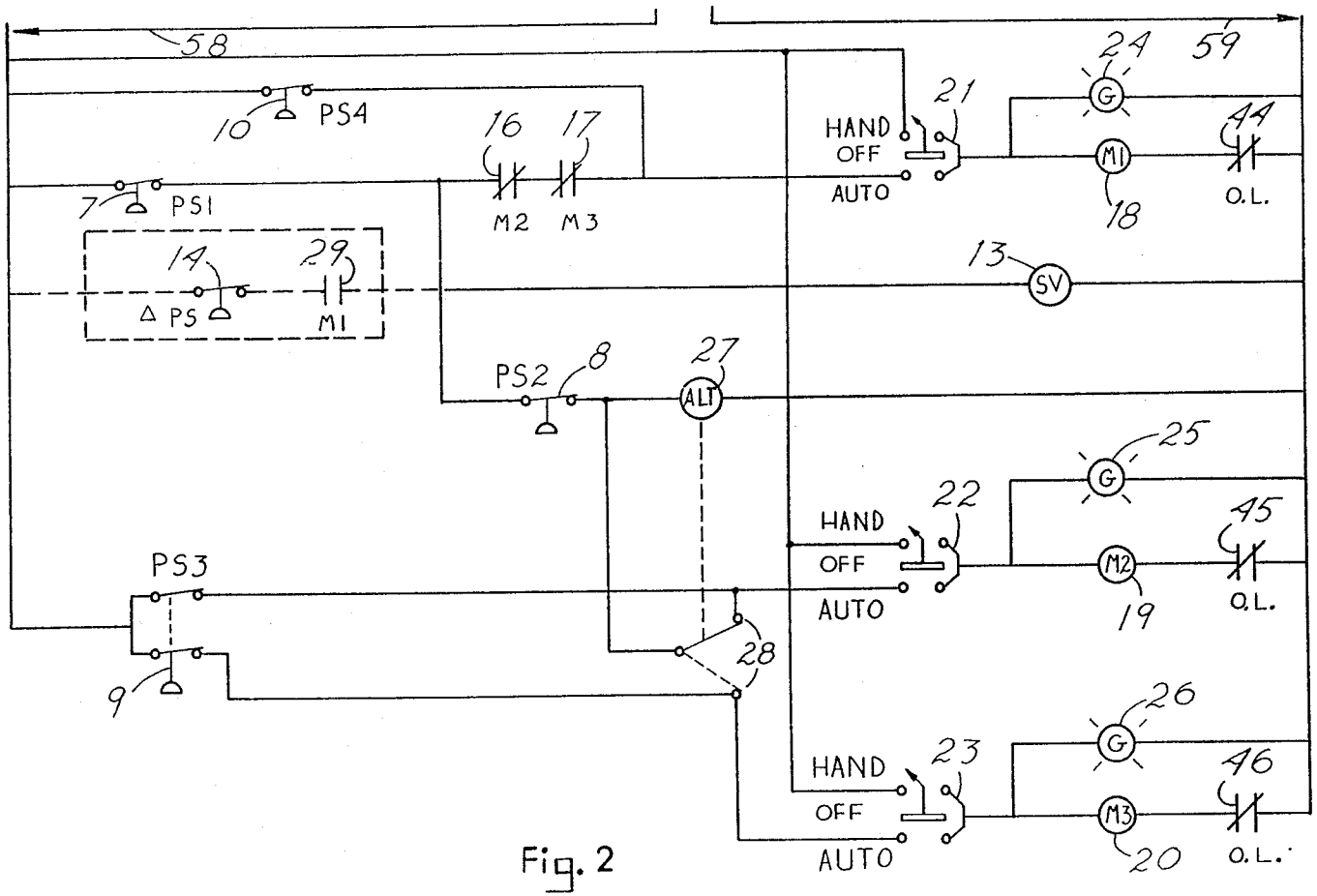
FIG. 2 is a combined circuit and systematic diagram of the control system according to the present invention.

FIG. 2 is an electrical schematic which is verbally defined in the SEQUENCE OF OPERATION describing the function of each component in operating detail.

Figure 3:
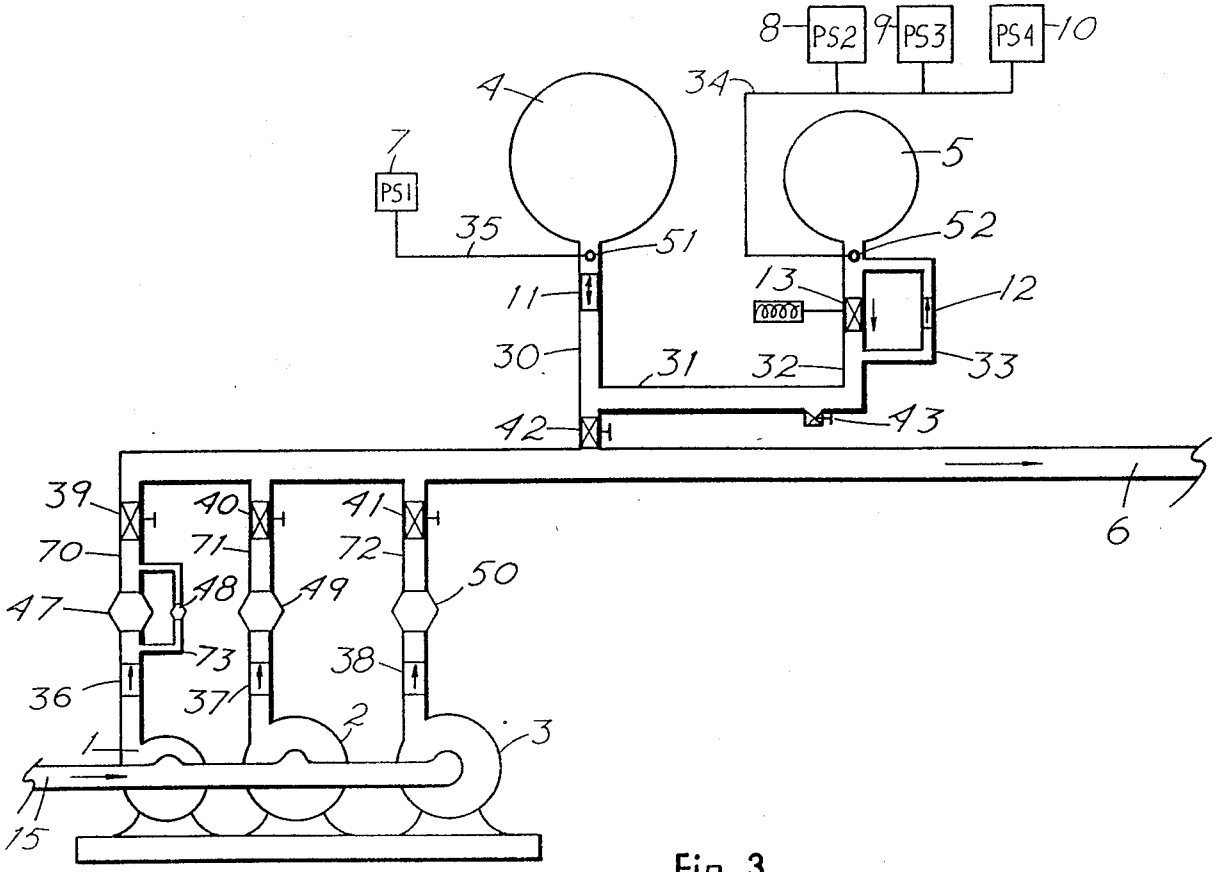
FIG. 3 is as FIG. 1, showing pressure reducing values added to the system.

FIG. 3 is a diagramatic form of the present invention as described in FIG. 1 with the addition of the following: pressure reducing valves 47, 48, 49 and 50 which are placed in lines 70, 73, 71 and 72 respectively.

Figure 4:
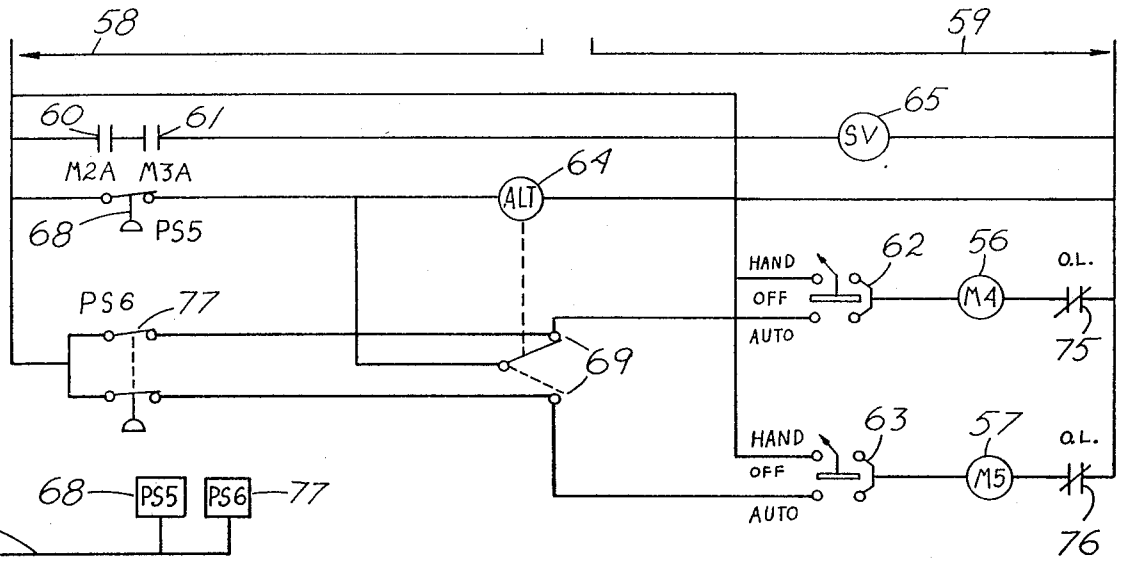
FIGS. 4 and 5 show the controls for adding additional pumps to the system with the means of tank three.
Figure 5:
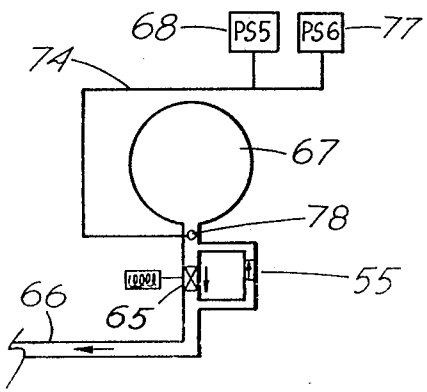

FIGS. 4 and 5 is an electrical and piping schematic which is verbally defined in the sequence of operation describing the function of each component in operating detail.

SEQUENCE OF OPERATION

For explanatory purposes, let it be assumed that electrical power is being provided to the system, the system is properly connected hydraulically to inlet and outlet plumbing, water is being supplied to the inlet by a regulated source of supply, and the system is set up for automatic operation. Present system demand is zero, both primary and secondary tanks are fully charged and all pumps are idle due to the zero demand condition. This can be referred to as static or standby service condition. Referring to the drawings, FIGS. 1 and 2, the sequence which will occur when demand is placed on the system will be as follows: Water will be drawn from the primary tank FIG. 1, (4) to service needs, FIG. 1, (6) until the pressure in the primary tank is reduced to the set point of pressure switch PSI, FIG. 1, (7) this is usually 10 to 20 PSI below the pressure at which PSI, FIG. 1, (7) opens to stop the number one pump, FIG. 1, (1). When pressure switch one closes its contacts (refer now to FIG. 2, (7) it completes an electrical circuit through the normally closed auxiliary starter contacts FIG. 2, (16 and 17) of motor starters M2 and M3 FIG. 2, (18 and 19) and through the closed contacts of hand off auto selector switch FIG. 2, (21) to energize motor starter one FIG. 2, (18) and its running indicator lamp FIG. 2, (24). Simultaneously energized by pressure switch one is the secondary tank solenoid valve FIG. 1, (13) and FIG. 2, (13). Pump number one is started in the conventional manner by closure of the motor starter contacts, supplying power to the motor windings (as will be pumps 2 and 3 FIG. 1, in later descriptions).

Water will now be supplied to the service both from the number one pump and from the secondary tank through the now opened normally closed solenoid valve FIGS. 1 and 2, (13). The primary tank FIG. 1, (4) places no appreciable draw on the system because the fill rate is restricted to a small volume by the orificing through the seat of the check valve FIG. 1, (11). If the demand is small, the pressure in the secondary tank FIG. 1, (5) will be reduced only slightly, and the number one pump will continue in operation to supply service demands and recharge the primary tank FIG. 1, (4). When demand is increased beyond the capacity of the number one pump the secondary tank pressure will quickly be reduced by the discharge of water to service needs through the open solenoid valve FIGS. 1 and 2, (13). When pressure is reduced to the set point of pressure switch two FIGS. 1 and 2, (8) the contacts close to complete a circuit through the closed contacts of the electric alternator FIG. 2, (28) and through the closed contacts of the auto section of the number two pump hand off auto selector switch FIG. 2, (22) to the coil FIG. 2, (19) of the number two pump magnetic motor starter, placing number two pump FIG. 1, (2) into operation and energizing the number two pump running indicator lamp FIG. 2, (25). Simultaneously with closure of pressure switch two contacts, the coil of the electric alternator FIG. 2, (27) will become energized. Simultaneous with actuation of magnetic motor starter number two the auxiliary starter contact M2 FIG. 2, (16) opens to break the operating circuit to pump number one. Pump number one stops and service demand is now supplied by the output of pump number two through the 20 to 40 percent system design capacity range.

Both primary and secondary tanks accept recharge pressure when service pressure is greater than tank pressure, through the orifice check valve FIG. 1, (11) to the primary tank and through the small bypass line FIG. 1, (33) and check valve, FIG. 1, (12) to the secondary tank. Conversely with increasing service demands and reducing pressure, both the primary and secondary tanks will supply water as available to service needs; the primary tank through the unrestricted direction of flow through the orifice check valve FIG. 1, (11) and the secondary tank through the open solenoid valve FIG. 1, (13). With increased demand and further reduction in pressure to the set point of pressure switch three FIGS. 1 and 2, (9) the contacts close to complete an operating circuit to the number three magnetic motor starter FIG. 2, (20) and to the number three pump running indicator lamp FIG. 2, (26). Pressure switch three also completes a redundant operating circuit to pump number two, through the upper set of contacts FIG. 2, (9) which has no effect since pump two is already in operation. Likewise the normally closed M3 auxiliary contact FIG. 2, (17) opens but performs no function because the required function (stopping the number one pump) was previously performed by the M2 auxiliary contact FIG. 2, (16). The number three pump is started by the magnetic starter in the conventional manner and the number two and three pumps operate in parallel to provide service requirements through the 40 to 80 percent range of system design capacity. While in this mode of operation, both primary and secondary tanks continue to function as previously described to charge and discharge to stabilize system output pressure and assist the pumps in meeting service demands. As additional demand is placed upon the system, the pressure will be further reduced to the set point of pressure switch four FIGS. 1 and 2, (10) upon closing its contacts, pressure switch four completes a second operating circuit to the motor starter number one FIG. 2, (18) bypassing the initial start circuit and the cut-out circuit of the M2, M3 FIG. 2, (16) and (17) normally closed auxiliary starter contacts. Starter number one operates, placing number one pump into operation and number one pump running lamp FIG. 2, (24) will be simultaneously lighted. The system is now operating at full design capacity to meet service damands of 80 to 100 percent of full system design capacity and will continue in this mode of operation until service demand is reduced.

When flow demand is reduced, system pressure in both the primary and secondary tanks will increase. Pressure switches PS4, PS3 and PS2 FIG. 2, (7) (8) (9) will be opened in reverse order from that in which they closed. As each switch opens the pump that was being controlled by the respective switch will be stopped. When pressure switch two opens FIG. 2, (8) it will also deenergize the coil of the alternator FIG. 2, (27). When the coil deenergizes the alternator contacts FIG. 2, (28) shift to the opposite position, thereby selecting the number three pump to be the first sequence main pump for the next cycle of operation. When the number two magnetic starter FIG. 2, (19) is deenergized its normally closed auxiliary contact M2 FIG. 2, (16) which completes the restart circuit to number one pump through the previously closed (when pump three was stopped) M3 auxiliary motor starter contact FIG. 2, (17). Pump number one restarts to provide low system demand and recharge the primary and secondary tanks. When the primary tank pressure is increased to the actuation point of switch one FIGS. 1 and 2, (7) the switch opens to stop the pump and return the system to the static service condition where it will remain until such time as demand is placed upon it to begin a new cycle of operation.

STAGING ADDITIONAL PUMPS AS IN FIGS. 4 AND 5 WITH SEQUENCE OF OPERATION

The invention is readily adaptable to controlling additional pumps within a common system without extensive modifications. FIGS. 4 and 5 are provided as an example for field addition of two pumps to the previously described three pump system. To facilitate control, a third tank FIG. 5, (67) of equal or slightly less capacity than the secondary tank is piped in parallel to the secondary tank FIG. 1, (5) and is provided with similar flow control devices consisting of normally closed solenoid valve FIG. 5, (65) and bypass check valve FIG. 5, (55). The check valve and the tank combination are selected to provide a slightly faster rate of recharge than the secondary tank. With the arrangement shown, the added pumps will be controlled by magnetic motor starters M4 and M5 FIG. 4, (56 and 57) and will be entered into the systems operational sequence after the second sequence main pump of the three pump system is started. Control power for the two pumps being added is from the common source supplying the basic three pump system FIGS. 2 and 4, (58 and 59). The only electrical components required to be added to the basic triplex control panel are the auxiliary motor starter contacts M2A and M3A FIG. 4, (60 and 61). Magnetic motor starters M4 and M5 FIG. 4, (56 and 57) with the associated hand off auto control switches FIG. 4, (62 and 63) and the alternator FIG. 4, (64) are used for controlling the pumps being added and can be provided in a separate duplex pump control panel.

When the second sequence main pump of the basic three pump system is started, auxiliary motor starter contacts M2A and M3A FIg. 4, (60 and 61) will both be in the closed position. Power is then applied to the normally closed solenoid valve FIG. 4, (65) on the discharge line FIG. 5, (66) of tank three FIG. 5, (67). Water from tank three is now discharged to augment the output of pumps two and three, FIG. 1, (2 and 3).

When pressure drops to the set point of pressure switch PS5 FIGS. 4 and 5, (68) its contacts will close, the alternator coil FIG. 4, (64) will become energized, and power will be applied through the closed contacts FIG. 4, (69) of the alternator and through the closed contacts of the hand off auto selector switch FIG. 4, (62) set in the auto position to the coil of magnetic motor starter M4 FIG. 4, (56). When the main contacts of M4 close, pump number four will be placed into operation to supply additional water to the service. With additional service demand the pressure in tank three FIG. 5, (67) will be reduced further. When it reaches the set point of pressure switch PS6 FIGS. 4 and 5, (77) its contacts will be closed to energize magnetic motor starter M5 FIG. 4, (57) through the closed contacts of hand off auto selector switch FIG. 4, (63). Pumps two, three, four and five now operate simultaneously to supply system demands. If pressure continues to be reduced, pressure switch PS4 FIG. 2, (10) of the basic system will close its contacts at the set point and restart pump number one FIG. 1, (1) of the basic system. Pumps one through five will now operate simultaneously to supply maximum system design capacity to service needs, and will remain in operation until service demand is reduced. When service demand is reduced, the pressure in the secondary tank FIG. 1, (5) and in tank number three FIG. 5, (67) will be increased. Pressure switches PS4, FIG. 2, (10) PS5 FIG. 4, (68) and PS6 FIG. 4, (77) will reopen in reverse order from that in which they closed and stop the respectively controlled pump. When pressure switch PS5 FIG. 4, (68) opens its contacts, the alternator FIG. 4, (64) will become deenergized and shift the contacts FIG. 4, (69) to the opposite position to select pump number five for the first sequence of operation when the next operational cycle requiring pump four or five is required.

GENERAL COMMENTS ON SYSTEM OPERATION

When pump number one is started in the first sequence, the primary tank charge is depleted by approximately 90 percent, and the system pressure is at its lowest operating value. At the instant of pump number one starting, pressure in the system begins to increase, not only from the pump output, but also from the charge in the secondary tank. System control is transferred from the static mode of the primary tank to the dynamic mode of the secondary tank. Thus, the ability to combine the advantage of the large reservoir capacity of the primary tank, and the ability to accurately sequence and provide timing control to the pumps, while operating without overloading, and at the system design pressure, is achieved. More simply stated, the secondary tank controls pump sequencing at system design pressure, while the primary tank controls the static system pressure which is allowed to vary through the optimum differential range of the primary tank. The dual tank feature enables dual pressure sensing to suit the mode of operation, and provides dual range control.

The ability of the two hydropneumatic tanks to augment pump output during dynamic operation provides a high degree of stability and efficiency to the system. Under conditions of varying flow demand, the tanks continually charge or discharge water to assist the pumps in meeting system requirements. Brief surge demands can be supplied by the tank output without switching to a larger pump or starting an additional pump (as occurs with flow activated switching devices). Minimum run periods for the pumps are established by the differential band of the pressure switches employed, and the time period required to increase the pressure in the secondary tank through the range of pressure switch differential. This eliminates the possibility of the pump short cycling (and also eliminates the need for electrical or electronic minimum run timers). In effect, the secondary tank becomes a dampened switching chamber, protected from the effects of surge demands (which can be supplied by the tanks reservoir capacity), is not at all effected by pressure spikes, and provides as the end result a highly stable, accurate and simple means to sequence pumps in automated multipump systems.

The degree of accuracy in switching/sequencing the pumps is limited primarily by the quality and design of the pressure switches and the size of the secondary tank. By sizing the lead pump for a slightly higher pressure than the main pumps, the tanks can be charged to a pressure of 5 to 10 PSI above system design requirements, which then permits sequencing to the first main pump at system design pressure, starting the second main pump slightly (2 to 5 PSI) below system design pressure, and the restart of the lead pump at 5 to 10 PSI below system design pressure. Thus a very narrow band for switching control can be established, and is limited only by the degree of sophistication of the switching devices and the size of the secondary tank.

PUMP FAILURE MODE OF OPERATION

With competitive systems this feature is usually offered as an extra cost option and consists of a relay logic circuit actuated by a pressure switch. The logic is such that should the pressure at any time be reduced to the set point of the pressure switch, conclusion is drawn that the pump that should be operating has failed; usually the conclusion is also drawn that the pump that should have been in operation at the particular time of the occurence was the number one or lead pump. Therefore the title "lead pump failure" is commonly applied to this optional feature. The relay logic applied functions to start the first sequence main pump and lock it into continuous operation until such time as a manual reset button is pressed. An audible or visual alarm is also actuated on this condition. The relay logic may function to remove the failed lead pump from service but does not in all cases do so.

Pump failure feature of the invention is an inherent design characteristic. Because the dynamic control of this system is exercised by means of a pressure being maintained within the secondary tank, the system will simply bypass any pumps in the operating sequence which fail to provide proper output, and select the pump in the next sequence position of operation to meet service requirements. In selecting this alternate pump to provide service demand, it will not be sequenced into continuous operation until manually reset, but will be placed into operation only for so long as is required to meet service demands. The pump will then be shut off in the normal manner and the system will automatically be reverted into the static service condition. The only observable effect will be that if the number one pump was the failed unit, the primary and secondary tanks will not be recharged to the full pressure normally attained when the system sequences into the static service condition. The total system capacity will of course be reduced by the capacity of the failed pump.

HIGH SUCTION PRESSURE SHUT OFF

This is an energy saving feature which is normally offered as an extra cost option on competitive systems. It functions to prevent the pumps from operating at any time that the system inlet (supply) pressure is high enough to supply service needs without requiring a pressure boost. This is a standard design characteristic of the invention and is furnished on all systems. Function is quite simple and is performed by pressure with PSI FIGS. 1 and 2, (7). Since the inlet pressure will pass directly through all pumps and into the primary tank FIG. 1 (4) at any time that the inlet pressure is higher than the set point of pressure switch PSI FIGS. 1 and 2, (7) PSI will remain in the open position and the pumps will not be started. Service demands will be provided by the inlet pressure.

CONTROL OF SYSTEM HAVING VARIABLE INLET (SUCTION) PRESSURE AND NOT FURNISHED WITH PRESSURE REDUCING VALVES

When a water booster system must operate under conditions of having a variable inlet pressure, the minimum inlet pressure must be utilized as the base value in determining the set points for all of the pressure switches used for starting and sequencing the pumps. This is essential to prevent the pumps from failing to shut off under conditions of minimum inlet pressure. For installations wherein the inlet pressure fluctuates through a wide range of variation, efficiency of such systems can be improved by the addition of a differential pressure switch FIGS. 1 and 2, (14). The differential pressure switch functions to prevent the pumps from shutting off as a result of an increase in the inlet pressure. It maintains the number one pump in operation until such time as the primary tank pressure FIG. 1, (4) equals the combined pressure of the inlet pressure plus the set pressure of the differential pressure switch. In this manner, both the primary tank, FIG. 1, (4) and the secondary tank, FIG. 1, (5) will be charged to the maximum pressure attainable at the time at which the differential pressure switch opens to stop the number one pump and place the system into static mode of operation. Hydraulic connections of the differential pressure switch are to the suction manifold FIG. 1, (15) for the low pressure side and to the pressure sensing point of the primary tank FIG. 1, (51) for the high pressure side. The electrical power for the maintaining circuit to the number one pump is through the closed contacts of the differential pressure switch, FIG. 2, (14), through the closed M1 auxiliary starter contact, FIG. 2, (29) and then through the normal operating circuit for motor starter number one FIG. 2, (18) as previously described.

EXPANSION CAPABILITY

The operational description provided for staging additional pumps as in FIGS. 4 and 5 illustrates; The basic operational simplicity with which additional pumps may be controlled by applying the same principle of operation as the basic invention employs. This method of staging and controlling with a specific design pressure range, a virtually unlimited number of pumps without requiring complex relay or electronic circuitry is a unique advantage of the invention. The basic features derived by this means of control are retained throughout the full operational range of the system. Heretofore a five pump automated pump control system providing the standard design features of this system could only be undertaken by employing the highest state of the art technology utilizing costly and complex relay and electronic controlling devices. The cost of such control systems can far exceed the cost of the pumps. This is not a forseeable occurence with this method of control. There are varied methods in which additional pumps can be staged and sequenced into the system. Depending upon system design tolerances it is conceivable that as many as four or more pumps could be controlled by a single dynamic control tank. The method of alteration/sequencing the pumps to equalize operating hours is totally flexible. Any type of multi-pump sequencing device could be employed. In undertaking the design of this system, basic simplicity of control combined with highest reliability and minimum cost has been a foremost objective.

What is claimed is:

1. A multi-pressurized-reservoir multi-pressurizing means condition responsive pressure controlled pressure booster system comprising:

a. a plurality of pressurizing means, hereafter referred to as pumps 1, 2, and 3, connected to a common suction manifold providing inlet fluent service, said pumps plumbed in parallel having a check valve on the discharge side joined into a common main servicе line;

b. a primary pressurized reservoir, hereafter referred to as a primary tank, connected to said service line with an inline restricted fill rate means hereafter referred to as an orificed check valve and pressure switch means, for control of said pump 1, with sensing point located at said primary tank discharge aperture and a secondary pressurized reservoir, hereafter referred to as a secondary tank, joined to said service line by a connecting line equipped with an inline fluent egress flow control means, hereafter referred to as a solenoid valve, and fluent ingress restricted fill rate means hereafter referred to as a check valve bypass line to provide controlled refilling time of said secondary tank, and a plurality of pressure switches with a common service line connected to the sensing point adjacent to said secondary tank discharge aperture with said pressure sensing switches individually preset to energize its respectively controlled pump as pressure demands whereby said system is capable of maintaining a narrow margin of pressure variation throughout design flow capacity and obtaining an improved degree of reliability, energy efficiency, diverse operational features, simplicity, and greatly reduced cost.

* * * * *

UNITED STATES PATENT AND TRADEMARK OFFICE

CERTIFICATE OF CORRECTION

PATENT NO. : 4,897,022

DATED : January 30, 1990

INVENTOR(S) : Carl E. Hudson

It is certified that error appears in the above-identified patent and that said Letters Patent is hereby corrected as shown below:

Column 2 line 57, that portion in parenthesis reading:

(+=to+ PSI) should read --(+5 to +10 PSI)--.

Column 2 line 59, that portion reading:

-°PSI) should read -20 PSI)

Signed and Sealed this

Thirtieth Day of July, 1991

*Attest:*

*Attesting Officer*

HARRY F. MANBECK, JR.

*Commissioner of Patents and Trademarks*